US006332801B1

(12) United States Patent
Watanbe

(10) Patent No.: US 6,332,801 B1
(45) Date of Patent: Dec. 25, 2001

(54) INSULATION REPLACEMENT ELECTRICAL CONNECTOR

(75) Inventor: Satoshi Watanbe, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 09/650,994

(22) Filed: Aug. 31, 2000

(30) Foreign Application Priority Data

| | | |
|---|---|---|
| Sep. 1, 1999 | (JP) | 11-247574 |
| Dec. 20, 1999 | (JP) | 11-376842 |
| May 16, 2000 | (JP) | 12-143826 |
| Jun. 22, 2000 | (JP) | 12-227963 |

(51) Int. Cl.[7] ..... H01R 4/24
(52) U.S. Cl. ..... 439/409; 439/495; 439/942
(58) Field of Search ..... 439/409, 407, 439/492, 495, 493, 942

(56) References Cited

U.S. PATENT DOCUMENTS

| | | | | |
|---|---|---|---|---|
| 4,426,125 | * | 1/1984 | Crawford | 439/409 |
| 4,871,319 | * | 10/1989 | Babow | 439/495 |
| 5,554,053 | * | 9/1996 | Matthews | 439/942 |
| 5,904,586 | * | 5/1999 | Takayasu | 439/495 |
| 5,944,552 | * | 8/1999 | Hanami | 439/942 |
| 5,947,761 | * | 9/1999 | Pepe | 439/942 |

* cited by examiner

*Primary Examiner*—Hien Vu
(74) *Attorney, Agent, or Firm*—Kanesaka & Takeuchi

(57) ABSTRACT

A housing (1) supports a plurality of contact elements (21) with contact sections (27) making contact with core wires (C2) of cables. A press member (14) is rotatable between the open and closed positions with the housing (1). The press member (11) is provided with a receiving section (13) which has a guiding section (13A) opposed to the contact section at the open position and a retention section (13C) opposed to the contact section (27) at the closed position.

5 Claims, 8 Drawing Sheets

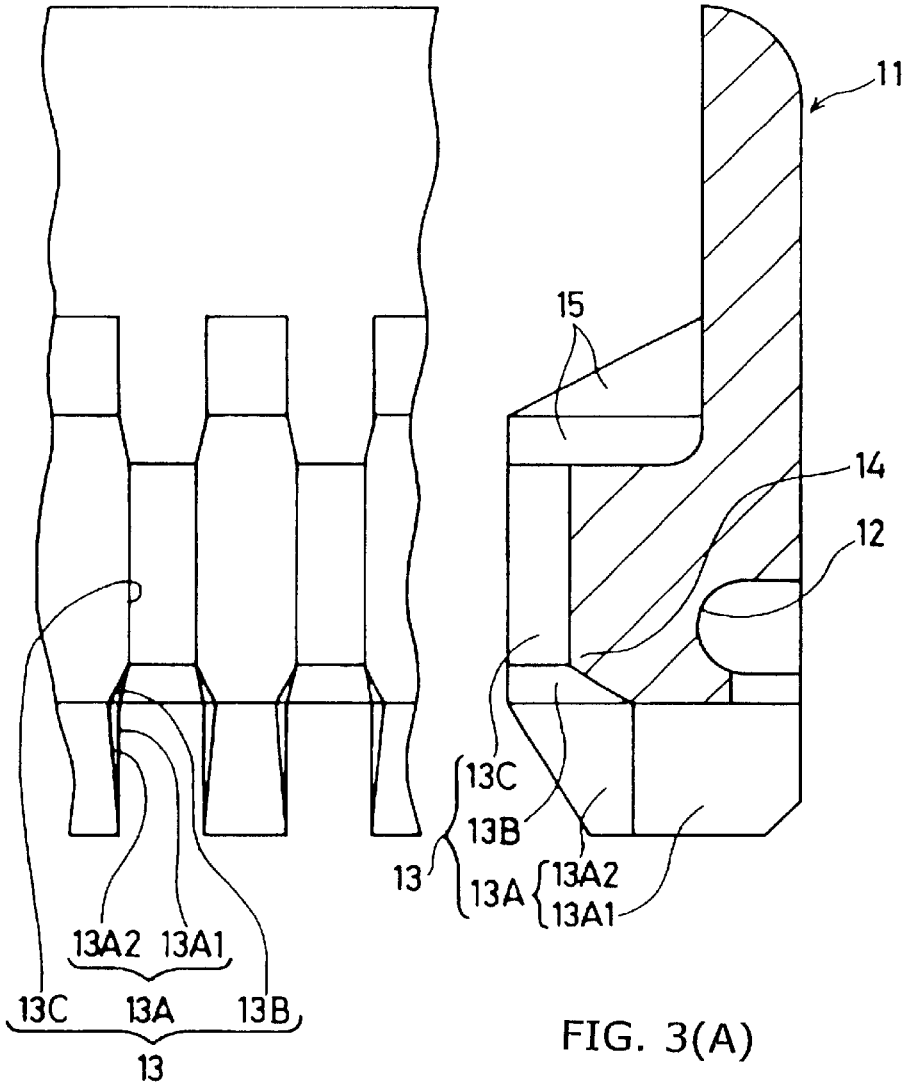
FIG. 3(A)
FIG. 3(B)
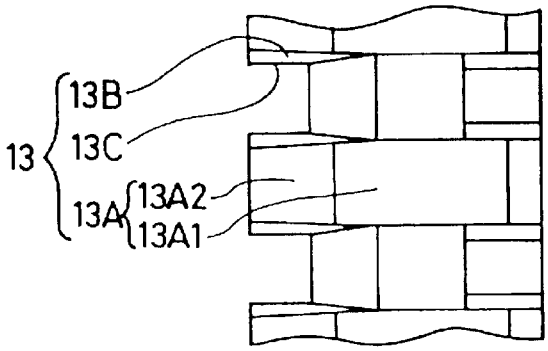
FIG. 3(C)

INSULATION REPLACEMENT ELECTRICAL CONNECTOR

BACKGROUND OF THE INVENTION

1. Field of the Invention

The present invention relates to electrical connectors and, particularly, to an electrical connector capable of connecting a contact element and a core wire of a cable by insulation replacement.

2. Description of the Related Art

The contact section of a press-connection or insulation-replacement contact element is made of a sheet of metal with side edges making contact with the core conductor or wire of a cable. An example thereof is disclosed in Japanese patent application Kokai No. 10255921.

As shown in FIGS. 7 and 8, a cable holder 52 is fitted in a first housing 51 while a plurality of contact elements 62 are held by a second housing 61. The first housing 51 has a rectangular shape, and the cable holder 52 has a retention section 53 and a protruded section 54 which projects from the first housing 51. A space 56 is provided between the first housing 51 and the top face of the retention section 53 to accommodate a cable arranging member 55 for holding a plurality of cables C at a dielectric section C1. A plurality of cable guiding grooves 56 are formed in the top, side, and bottom faces of the protruded section 54 of the cable holder 52 to guide core wires C2 from which the dielectric sections have been removed. The front ends of the core wires C2 are held by a retention tape 57 or the like to prevent uneven separation.

The contact elements 62 are made by stamping a metal sheet. Each contact element 62 has a base section 63 to be held by the second housing 61, a resilient arm 64 extending from the base section 63 in a U-shape, and a connection section 65 which projects from the second housing 61. A plurality of barbs 63A are provided on the base section 63 to keep the contact element 62 at a predetermined position in the second housing 61. A contact portion 64A is provided at the inside front end of each resilient arm 64. The protruded section 54 of the first housing 51 is fitted in the opening of the second housing 61 so that the core wires C2 in the guiding grooves 56 are brought into resilient contact with the contact portions 64A of the contact element 62.

In the above connector, the core wires are exposed in the press-connection or insulation-replacement sections so that the dielectric sections C1 as well as the core wires C2 are present in the guiding grooves 56. Accordingly, it is necessary that the width of the guiding grooves 56 be substantially equal to the diameter of the dielectric sections C1. Consequently, the width of the guiding grooves 56 is too large to keep the core wires C2 from moving laterally upon making resilient contact with the contact sections 64A, failing to provide stable contact. In addition, the width of the guiding grooves is likely made larger than the diameter of the dielectric sections for facilitating insertion thereof so that the position of the core wires becomes more variable.

SUMMARY OF THE INVENTION

Accordingly, it is an object of the invention to provide an electrical connector capable of facilitating insertion of a cable and stabilizing resilient contact the cable and a contact element.

According to the invention there is provided an electrical connector comprising a housing made of a dielectric material and at least one contact element supported by the housing and made of a metal so as to have a contact section. The connector is provided with a press member rotatable between a closed position and an open position with respect to the housing and having a press section for pressing a cable to the contact section at the closed position, wherein a cable receiving groove is provided on a surface of the press member which is opposed to the contact section, the cable receiving groove comprising a guiding section which faces the contact section when the press member is at the open position and a retention section which faces the contact section when the press member is at the closed position.

With such a structure, it is not necessary to expose the core wire of a cable. The cable is inserted into the housing with the press member is at the open position so that the cable is guided the guiding section of the receiving section provided on the press member. When the press member is rotated from the open position to the closed position, the engaging position of the cable moves from the guiding section to the retention section. Consequently, the cable is pressed by the press section of the press member against the contact section of the contact element for connection by insulation replacement while the cable is held in place by the retention section.

The press section is a bottom face of the retention section, the retention section of the receiving groove has a width substantially equal to or slightly smaller than a diameter of the cable, and the guiding section of the receiving groove having a width greater than the width of the retention section. Alternatively, the cable is a flat cable and the receiving section has a width substantially equal to or slightly smaller than a width of the flat cable, and the guiding section has a width greater than the width of the retention section.

The receiving groove has a transition section between the receiving and retention sections. The transition section has a width which gradually changes from the guiding section to the retention section. The contact element is made of a metal sheet such that the contact section is flat in a plane of the metal sheet, and the contact section has a side edge capable of making connection with a core wire of the cable by insulation replacement. At least one of the guiding and retention sections has a bottom surface of a V-shape cross section for assuring the constant cable position.

BRIEF DESCRIPTION OF THE DRAWINGS

FIGS. 3A, B, and C are sectional, side, and bottom views, respectively, of the press member;

DESCRIPTION OF THE PREFERRED EMBODIMENTS

Embodiments of the invention will now be described with reference to FIGS. 1–6.

Figure 1:
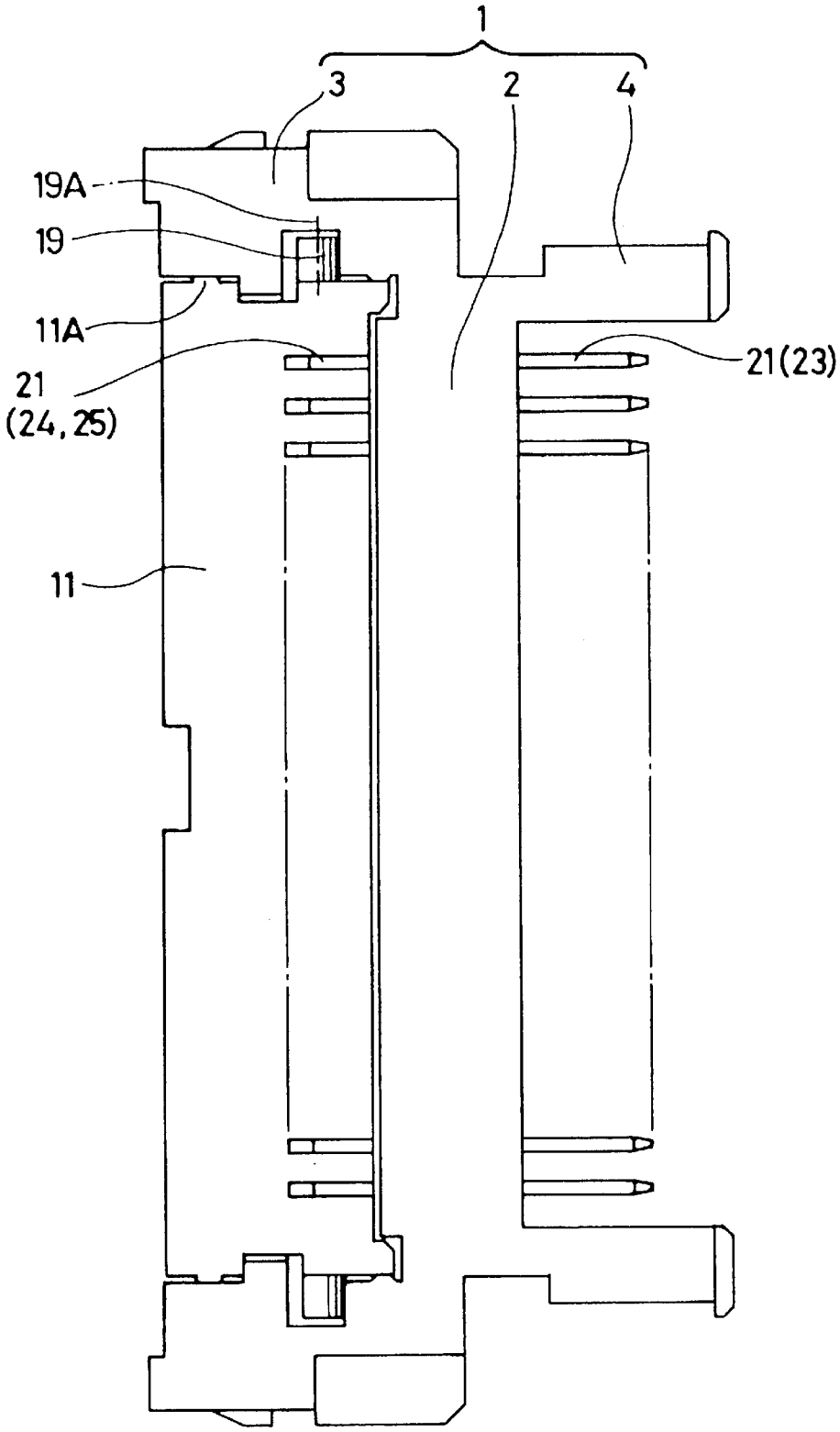
FIG. 1 is a plan view of an electrical connector according to an embodiment of the invention.

In FIG. 1, a connector comprises a housing body 1 and a press member 11, both of which are made of a dielectric material, and a plurality of contact elements 21 which are made of a metal sheet. The housing body 1 has an elongated body section 2, a pair of support arms 3 extending forwardly from opposite ends of the body section 2, and a pair of extension sections 4 extending rearwardly from the opposite ends of the body section 2. A plurality of contact elements 21 extend through the body section 2 at regular intervals. The press member 11 is pivoted at shafts 19 to the support arms 3 for rotation about an axis 19A in front of the body section 2. A pair of lock projections 11A are provided on opposite sides of the press member 11 for engagement with the inside edges of the support arms 3 so that the press member 11 is locked at such a closed position as shown.

The inside structure of the connector will be described with reference to FIGS. 2A–C which are taken along a plane parallel to the contact elements 21. A plurality of retention slits 5 extend through the body section 2 of the housing body 1 to receive the flat contact elements 21. Each contact element 21 has a base section 22 to be press fitted in the retention slit 5, a connection section 23 extends rearwardly from the base section 22 and projects from the body section 22, and upper and lower arms 24 and 25 which extend forwardly from the base section 22 to form a U-shape. An engaging projection 22A is provided on the lower edge of the base section 22 to keep the contact element in place. A shaft section 26 with a circular edge is provided on the front end of the upper arm 24. The center of the shaft section 26 is aligned with an axis 12A of a bearing section of the press member 11. The lower arm 25 is flexible in the vertical direction and has a contact section 27 consisting of a pair of triangular projections provided on the front inside edge thereof.

Figure 4:
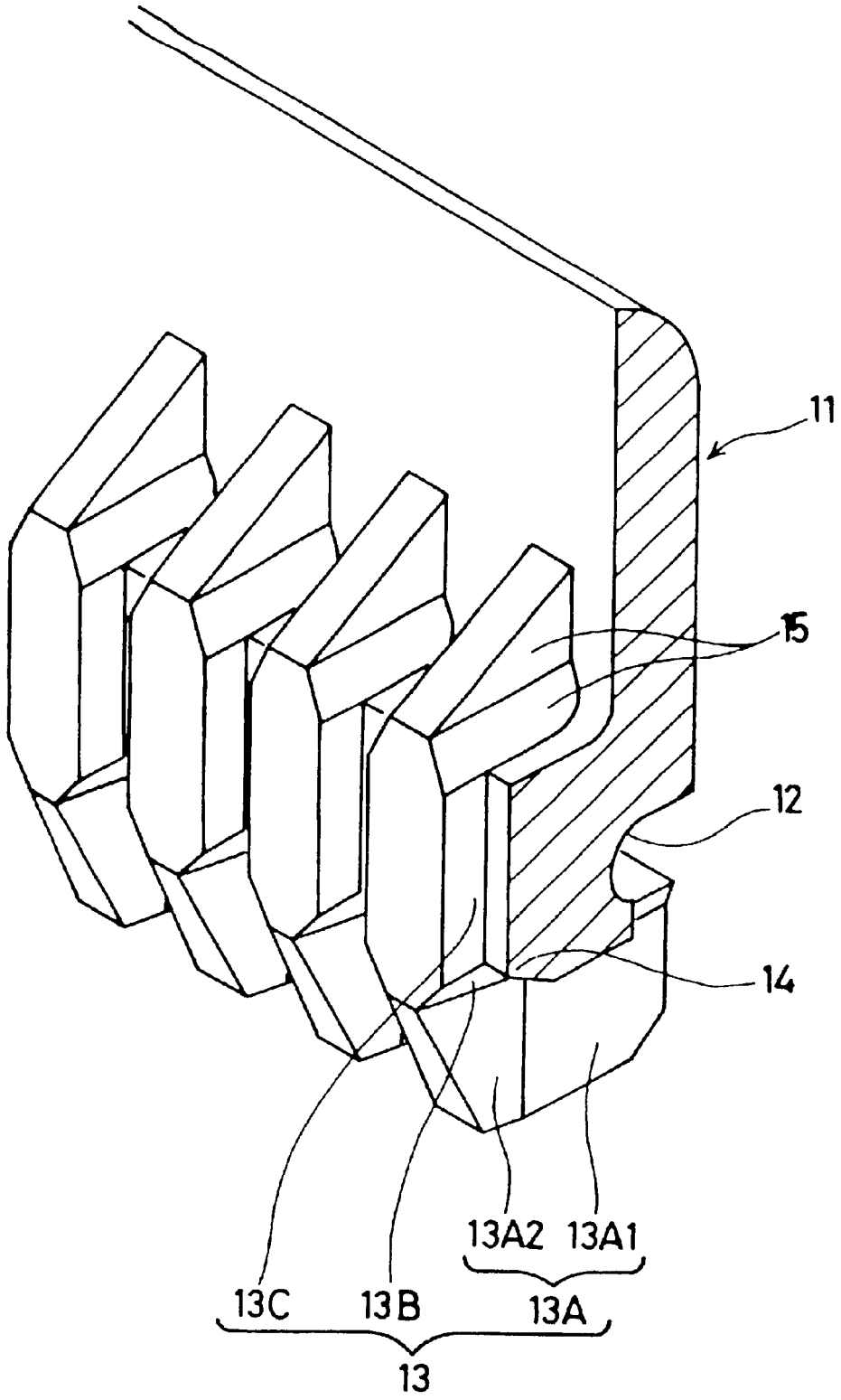
FIG. 4 is a perspective view of the press member.

As shown in FIGS. 2–4, the shaft sections 26 of the contact elements 21 form a comb-like shaft about which the concave circular bearing section 12 of the press member is rotated. A plurality of receiving grooves 13 and a press section 14 are provided on the face of the press member 11, which is opposed to the contact sections 27 of the contact elements 21, to receive the cables C.

As best shown in FIGS. 3A–B, the receiving groove 13 has a guiding section 13A, a transition section 13B, and a retention section 13C. The guiding section 13A is formed at such a position as to face the contact section 27 of the contact element 21 when the press member 11 is at such a open position as shown in FIG. 2A while the retention section 13C is formed at such a position as to face the contact section 27 when the contact element is at a such a closed position as shown in FIG. 2(C). The transition section 13B is formed at a transitional area between the guiding and retention sections 13A and 13C.

The width of the guiding sections 13A is made such that the cables are inserted without difficulty. In FIGS. 3A–B, the width of a guiding portion 13A2, which is closer to the transition section 13B, gradually increases toward the cable insertion end while the width of a guiding portion 13A1, which is deeper in the cable insertion direction, is constant. The "cable" herein described means the core wire C2 with the dielectric member C1 from which the shield wire has been removed. That is, the width of the guiding section 13A is made such that the dielectric member C1 can be inserted without difficulty. Where there is no shield wire, the cable means the core wire with a jacket or sheath.

The width of the retention section 13C is made equal to or slightly smaller than the diameter of the cable or the dielectric section C1. The width of the transitional section 13B gradually decreases from the guiding section 13A to the retention section 13C. The way of decrease can be either liner or being curved. The bottom faces of the transitional and retention sections 13B and 13C form a press section 14. A plurality of open sections 15 are provided behind the retention sections 13C and have a groove width larger than that of the retention sections 13C.

The press or insulation-replacement connection between the connector and the cable will be described below.

Figures 2A, 2B, 2C:
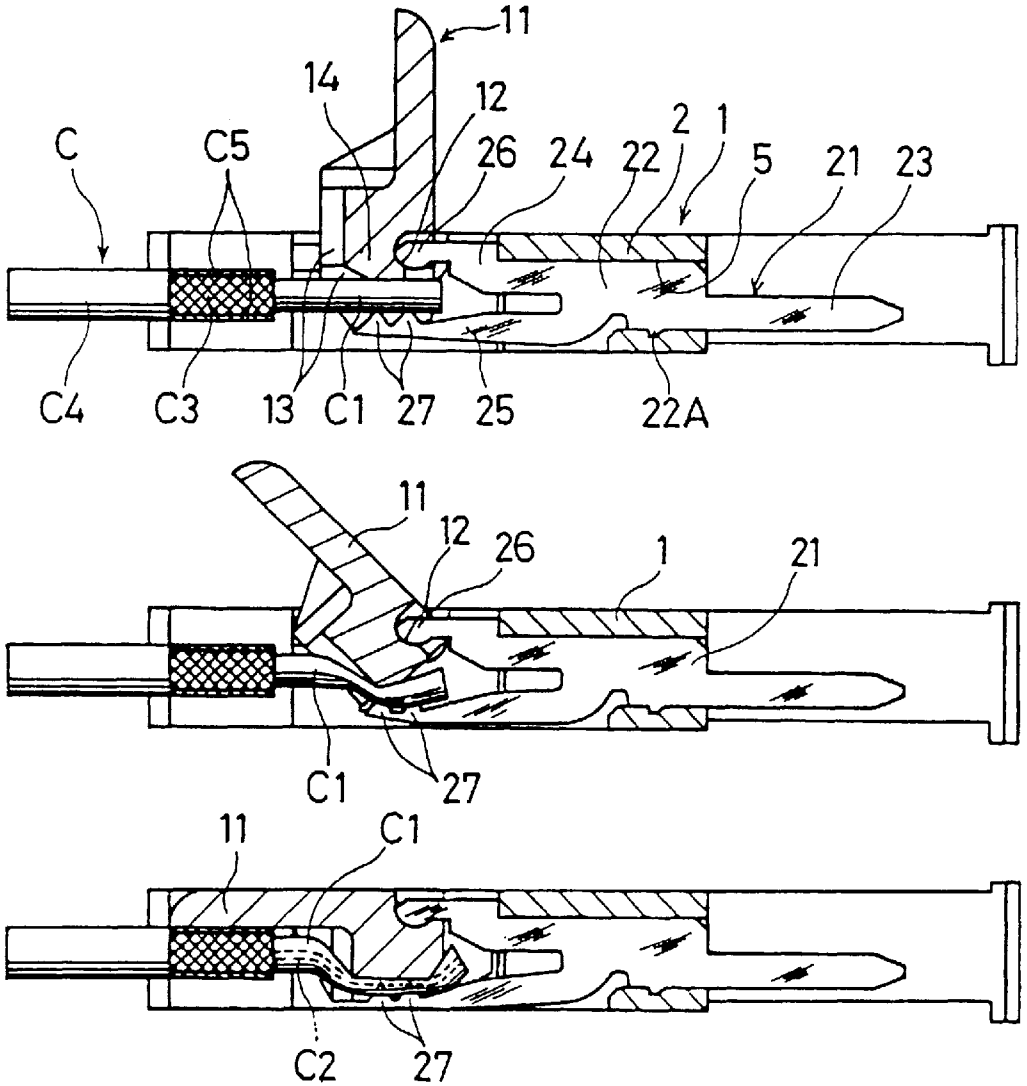
FIG. 2A is a sectional view of the connector with the press member at the open position.
FIG. 2B is a sectional view of the connector with the press member at a transition position.
FIG. 2C is a sectional view of the connector with the press member at the closed position.

(1) As shown in FIGS. 2A–C, where the cable is a coaxial cable, a jacket C4 and a shield wire C3 are removed from the front end portion to expose the dielectric member C1. Where there is no shield wire, the cable can be used as it is.

(2) A pair of retention members C5 of sheet metal are soldered to the shield wires C3 of a plurality of the cables on both upper and lower sides to hold them together.

(3) With the press member 11 kept at the open position, the cables (or dielectric sections C1) are put into the guiding sections 13A of the receiving grooves 13 above the contact sections 27 of contact elements 21. As best shown in FIG. 2A, the cables are inserted without difficulty from the guiding section 13 via the guiding portion 13A2 to the deeper guiding portion 13A1.

(4) The press member 11 is then rotated to the closed position in FIG. 2C via FIG. 2B. That is, the cables first are supported by the transitional sections 13B (FIG. 2B) and then held by the retention sections 13C (FIG. 2C), where they cannot move laterally but are kept at the predetermined positions so that the contact section 27 cuts into the cable without failure to make reliable contact with the core wire C2. Thus, the cables are press connected to the contact elements 21 of the connector.

Figure 5B:
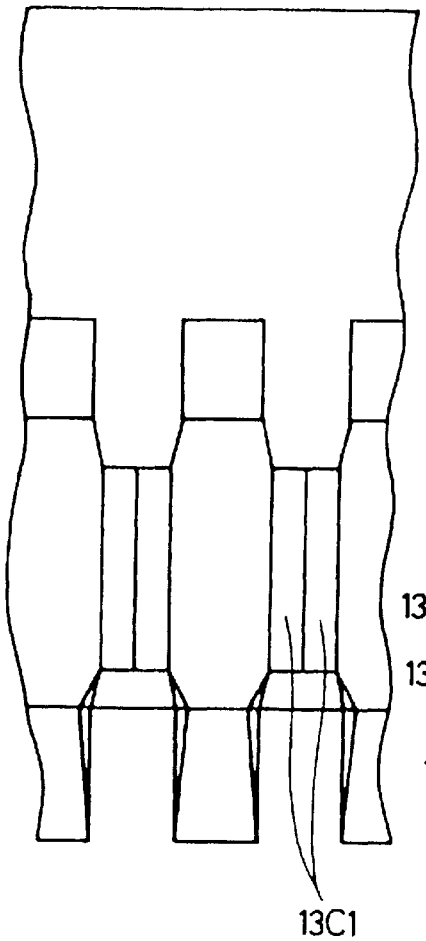
FIGS. 5A, B, and C are sectional, side, and bottom views, respectively, of a press member according to another embodiment of the invention.
Figure 5A:
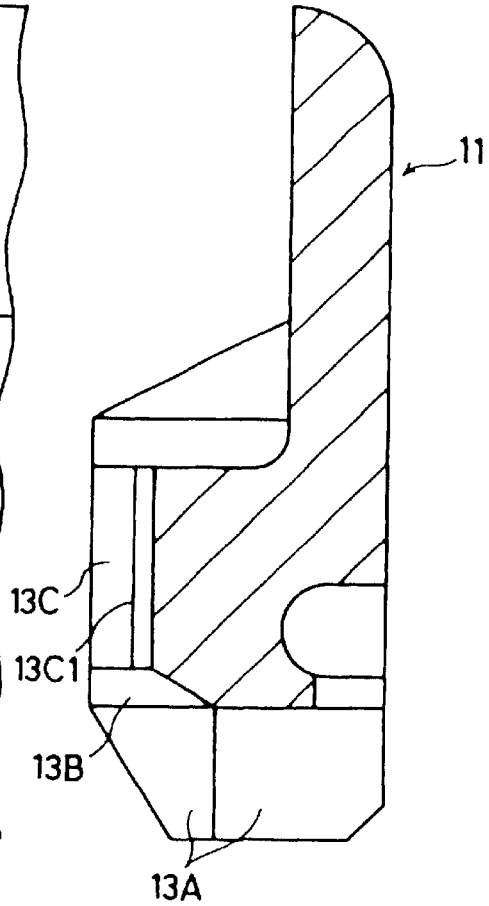
Figure 5C:
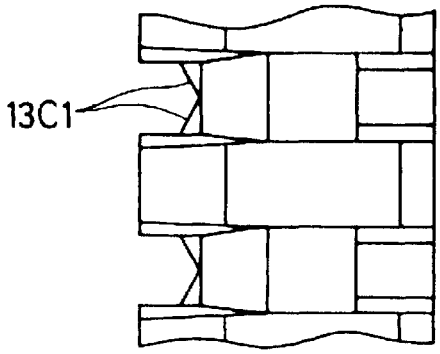

Alternatively, as shown in FIGS. 5A–C, the bottom faces 13C1 of retention sections 13C are made to have a V-shape cross section so that the cables are held at the center of the grooves when the cables are pressed.

Figure 6C:
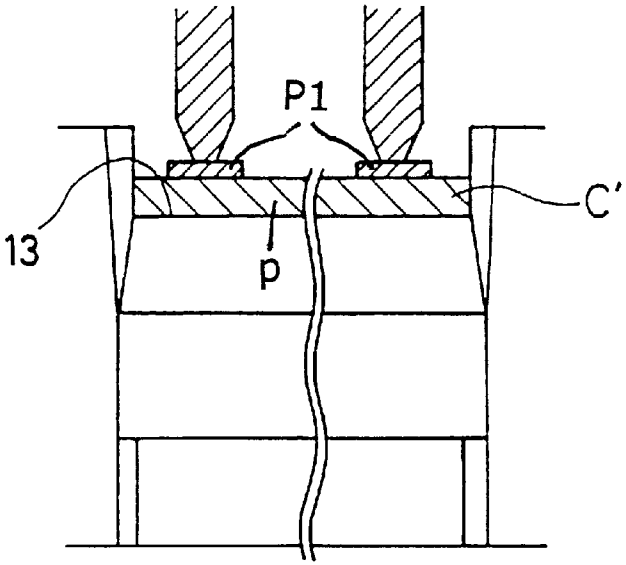
FIGS. 6A, B, and C are sectional, side, and bottom views, respectively, of a press member according to still another embodiment of the invention.
Figure 6B:
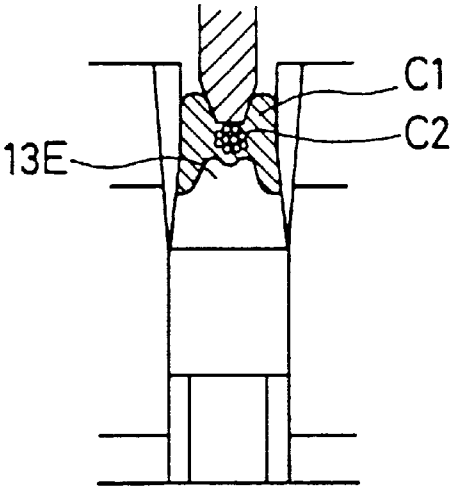
Figure 6A:
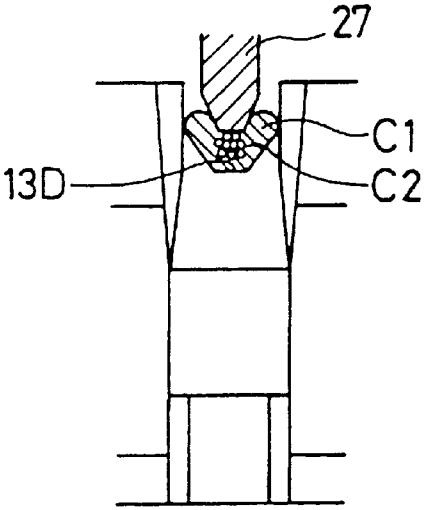
Figure 7:
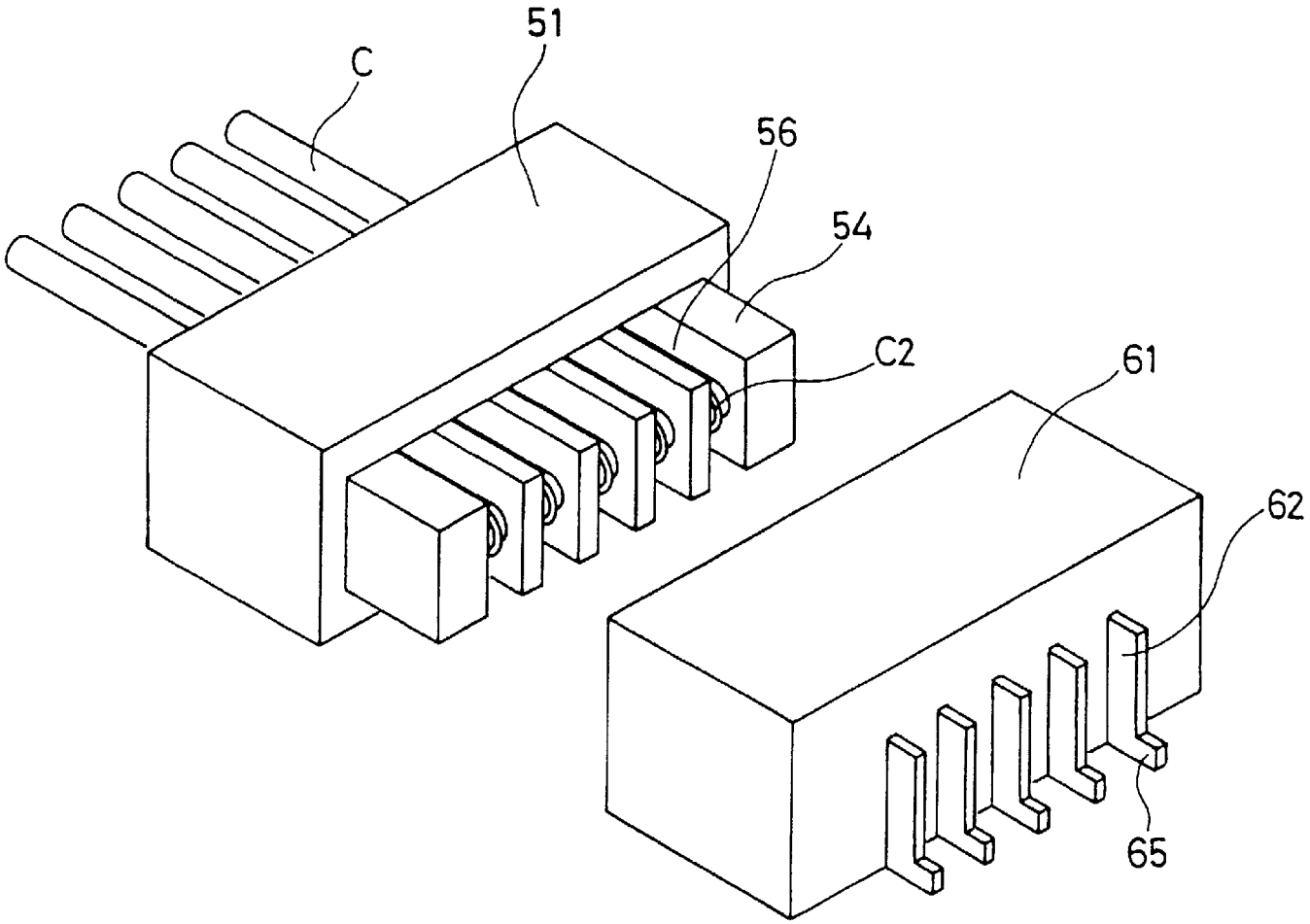
FIG. 7 PRIOR ART
FIG. 7 is a perspective view of a conventional connector.
Figure 8:
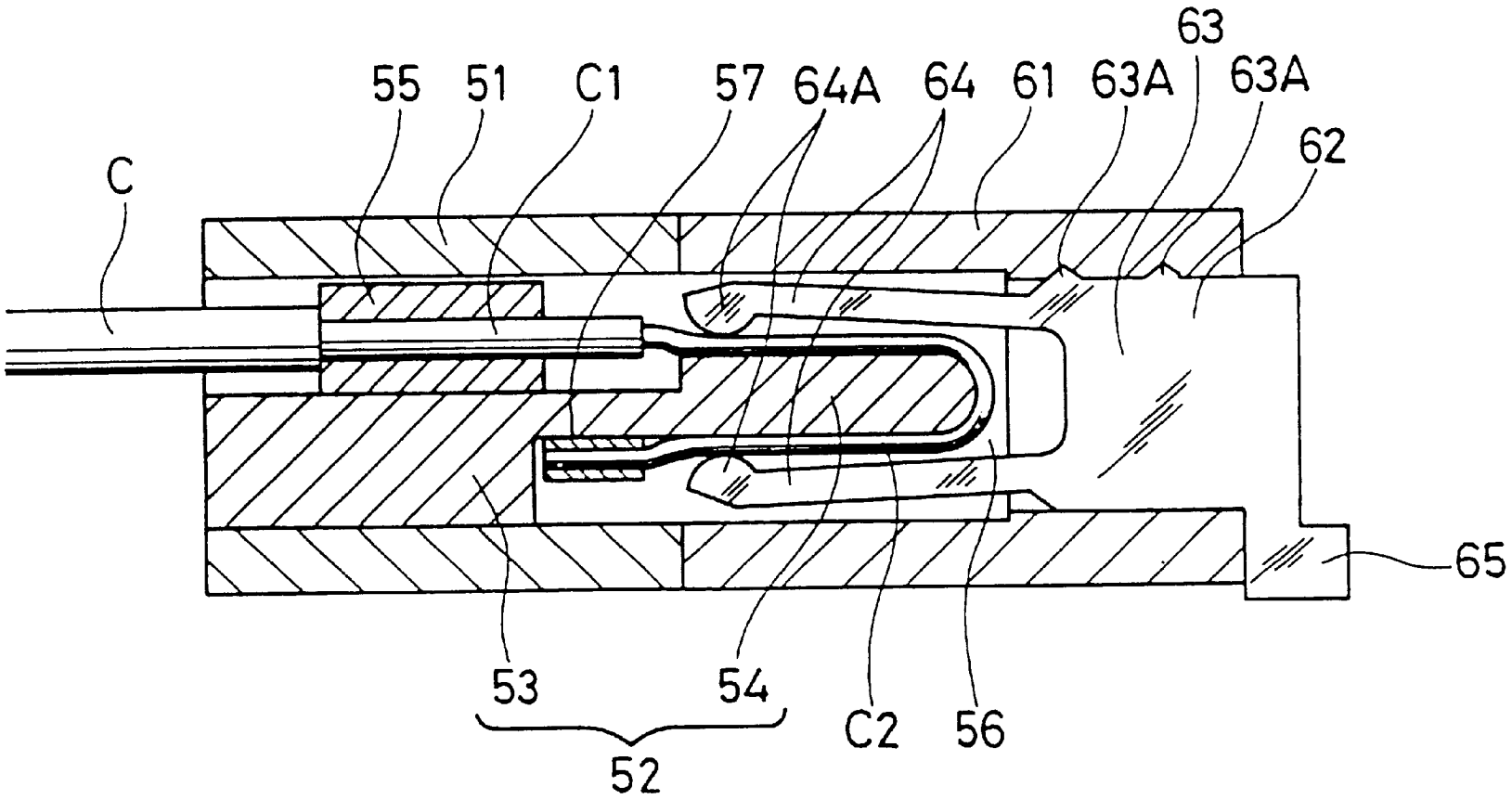
FIG. 8 PRIOR ART
FIG. 8 is a sectional view of the conventional connector in use.

As shown in FIG. 6A, in order to stabilize the lateral position of the core wire C2 even if the diameter of the core wire C2 of the cable C1 is small, a flat bottom 13D is provided on the V-shaped groove of the retention section 13. That is, it prevents the fine core wire from escaping into the bottom of the V-shaped groove when the contact section 27 cuts into the cable or dielectric section C1.

As shown in FIG. 6B, a ridge 13E is provided at the center of the groove bottom so that the dielectric member C1 can escape both sides of the ridge 13E, assuring stability of the core wire C2 in the widthwise direction.

In FIG. 6C, the cables are replaced by a flat cable C', such as a flexible printed circuit (FPC) board wherein a circuit section P1 is formed on a flexible board P or a flexible flat cable (FFC) wherein a plurality of cables are arranged in a plane. In this case, the press member 11 has a single wide groove 13 capable of receiving the flat cable C'.

As described above, according to the invention, the press member has at least one receiving groove to receive and hold a cable without difficulty such that the cable cannot move laterally in the retention section. Consequently, the contact sections are press connected to the core wires without failure. Thus, it is not only easy to insert cables but also possible to make reliable, automatic press connection simply by rotating the press member. In addition, the contact section cuts into the cable insulation to make connection so that removal of the cable insulation is eliminated.

What is claimed is:

1. An electrical connector comprising:

a housing made of a electrical material;

at least one contact element supported by said housing arid made of a metal, said contact element having a shaft section and a contact section including teeth;

a press member rotatable between a closed position and an open position with respect to said housing and having a press section for pressing a cable to said contact section at said closed position, said press member having a concave bearing section for receiving said shaft section, wherein a cable receiving groove Is provided on a surface of said press member which is opposed to said contact section, said cable receiving groove comprising:

a guiding section which faces said contract section when said press member is at said open position;

a retention section which faces said contact section when said press member is at said closed position; and a transition section provided between said guiding and rotation sections and having a width which gradually decreases from said guiding section to said retention section, wherein said cable is easily inserted into said cable receiving groove through said guiding section and being supported by said transition suction and said retention section while said pressing member is rotated from said open position to said close position, thus firmly press-fitting said cable to said teeth of said contact section of said contact element.

2. An electrical connector according to claim 1, wherein said press section is a bottom face of said retention section, said retention section of said receiving groove having a width substantially equal to or slightly smaller than a diameter of said cable, and said guiding section of said receiving groove having a width greater than said width of said retention section.

3. An electrical connector according to claim 1, wherein said cable is a flat cable, said press section is a bottom face of said retention section, said retention section has a width substantially equal to or slightly smaller than a width of said flat cable, and said guiding section has a width greater than said width of said retention section.

4. An electrical connector according to claim 1, wherein said contact element is made of a metal sheet such that said contact section is flat in a plane of said metal sheet, and said contact section has a side edge capable of making connection with a core wire of said cable by insulation replacement.

5. An electrical connector according to claim 1, wherein said retention section has a bottom surface of a V-shaped cross section.

* * * * *